US009808682B2

(12) United States Patent
DeMille et al.

(10) Patent No.: US 9,808,682 B2
(45) **Date of Patent: *Nov. 7, 2017**

(54) GOLF CLUB HEAD WITH A COMPRESSION-MOLDED, THIN-WALLED AFT-BODY

(71) Applicant: CALLAWAY GOLF COMPANY, Carlsbad, CA (US)

(72) Inventors: Brandon D. DeMille, Carlsbad, CA (US); Bradley C. Rice, Carlsbad, CA (US); Steven M. Ehlers, Poway, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/354,720

(22) Filed: Nov. 17, 2016

(65) Prior Publication Data

US 2017/0087426 A1 Mar. 30, 2017

Related U.S. Application Data

(63) Continuation of application No. 14/754,215, filed on Jun. 29, 2015, now Pat. No. 9,526,955, which is a continuation of application No. 14/681,909, filed on Apr. 8, 2015, now Pat. No. 9,504,883, which is a continuation of application No. 13/912,994, filed on Jun. 7, 2013, now Pat. No. 9,033,822, which is a continuation-in-part of application No. 12/939,477, filed on Nov. 4, 2010, now Pat. No. 8,460,123, which is a continuation-in-part of application No. 12/886,773, filed on Sep. 21, 2010, now Pat. No. 8,529,370, and a continuation-in-part of application (Continued)

(51) Int. Cl.
*A63B 53/04* (2015.01)

(52) U.S. Cl.
CPC .. *A63B 53/0466* (2013.01); *A63B 2053/0408* (2013.01)

(58) Field of Classification Search
USPC ..... 473/324–350
See application file for complete search history.

(56) References Cited

U.S. PATENT DOCUMENTS 4,545,580 A * 10/1985 Tomita ..... A63B 53/04 473/332
4,581,190 A * 4/1986 Nagamoto ..... A63B 53/04 264/136

(Continued)

FOREIGN PATENT DOCUMENTS

EP 1508418 A1 * 2/2005 ..... B29B 17/0042
WO WO 9933652 A1 * 7/1999 ..... B29B 9/04

*Primary Examiner* — Alvin Hunter
(74) *Attorney, Agent, or Firm* — Rebecca Hanovice; Michael Catania; Sonia Lari

(57) ABSTRACT

A multiple-material golf club and a method for forming said golf club is disclosed herein. The multiple-material golf club preferably is a driver that has a metal face cup and a thin-walled, compression molded, composite aft body with precise IML and OML geometry. The molding composite used to form the compression molded aft body preferably comprises a plurality of randomly oriented, pre-spread carbon fiber bundles and a thermoset or thermoplastic matrix material.

16 Claims, 5 Drawing Sheets

Related U.S. Application Data

No. 12/876,397, filed on Sep. 7, 2010, now Pat. No. 8,425,349.

(60) Provisional application No. 61/245,583, filed on Sep. 24, 2009, provisional application No. 61/242,469, filed on Sep. 15, 2009.

(56) References Cited

U.S. PATENT DOCUMENTS 4,650,626 A * 3/1987 Kurokawa ..... B29C 45/14 264/261
4,778,185 A * 10/1988 Kurokawa ..... A63B 53/04 473/332
5,364,571 A * 11/1994 O'Connor ..... C04B 35/622 264/29.5
6,010,411 A * 1/2000 Reyes ..... A63B 53/04 473/345
6,248,025 B1 * 6/2001 Murphy ..... A63B 53/04 473/324
6,471,604 B2 * 10/2002 Hocknell ..... A63B 53/02 473/334
6,558,271 B1 * 5/2003 Beach ..... A63B 53/04 473/327
6,565,452 B2 * 5/2003 Helmstetter ..... A63B 53/02 473/324
6,582,323 B2 * 6/2003 Soracco ..... A63B 53/02 473/329
6,602,149 B1 * 8/2003 Jacobson ..... A63B 53/04 473/329
6,612,938 B2 * 9/2003 Murphy ..... A63B 53/04 473/324
6,672,975 B1 * 1/2004 Galloway ..... A63B 53/04 473/342
6,739,982 B2 * 5/2004 Murphy ..... A63B 53/02 473/329
6,739,983 B2 * 5/2004 Helmstetter ..... A63B 53/02 473/329
6,743,118 B1 * 6/2004 Soracco ..... A63B 53/0466 473/324
6,994,636 B2 * 2/2006 Hocknell ..... A63B 53/0466 473/342
7,025,692 B2 * 4/2006 Erickson ..... A63B 53/0466 473/335
7,082,665 B2 * 8/2006 Deshmukh ..... A63B 53/0466 29/469
7,118,493 B2 * 10/2006 Galloway ..... A63B 53/02 473/224
7,128,664 B2 * 10/2006 Onoda ..... A63B 53/0466 473/345
7,166,038 B2 * 1/2007 Williams ..... A63B 53/0466 473/329
7,226,366 B2 * 6/2007 Galloway ..... A63B 53/0466 473/332
7,267,620 B2 * 9/2007 Chao ..... A63B 53/0466 473/342
7,311,613 B2 * 12/2007 Stevens ..... A63B 53/0466 473/329
7,479,071 B2 * 1/2009 Adams ..... A63B 53/0466 473/345
7,488,261 B2 * 2/2009 Cackett ..... A63B 53/0466 473/300
7,491,134 B2 * 2/2009 Murphy ..... A63B 53/0466 473/329
7,549,933 B2 * 6/2009 Kumamoto ..... A63B 53/0466 473/329
7,556,571 B2 * 7/2009 Adams ..... A63B 53/0466 473/342
7,559,851 B2 * 7/2009 Cackett ..... A63B 53/0466 473/300
7,568,982 B2 * 8/2009 Cackett ..... A63B 53/0466 473/300
7,607,992 B2 * 10/2009 Nishio ..... A63B 53/0466 473/342
8,430,986 B1 * 4/2013 Galloway ..... A63B 53/04 156/189
8,460,123 B1 * 6/2013 Demille ..... A63B 53/04 473/345
8,517,851 B2 * 8/2013 Cackett ..... A63B 53/0466 473/242
8,529,370 B1 * 9/2013 Galloway ..... A63B 53/0466 473/347
8,864,604 B2 * 10/2014 Matsunaga ..... A63B 53/00 473/346
8,870,680 B2 * 10/2014 Yamamoto ..... A63B 53/04 473/345
9,033,822 B1 * 5/2015 DeMille ..... A63B 53/0466 473/345
9,283,449 B1 * 3/2016 DeMille ..... A63B 53/0466
9,427,631 B1 * 8/2016 Larson ..... A63B 53/0466

* cited by examiner

GOLF CLUB HEAD WITH A COMPRESSION-MOLDED, THIN-WALLED AFT-BODY

CROSS REFERENCES TO RELATED APPLICATIONS

The present application claims priority to and is a continuation of U.S. patent application Ser. No. 14/754,215, filed on Jun. 29, 2015, which is a continuation of U.S. patent application Ser. No. 14/681,909, filed on Apr. 8, 2015, and issued on Nov. 29, 2016, as U.S. Pat. No. 9,504,883, which is a continuation of U.S. patent application Ser. No. 13/912,994, filed on Jun. 7, 2013, and issued as U.S. Pat. No. 9,033,822 on May 19, 2015, which is a continuation-in-part of U.S. patent application Ser. No. 12/939,477, filed on Nov. 4, 2010, and issued as U.S. Pat. No. 8,460,123 on Jun. 11, 2013, which is a continuation-in-part of U.S. Utility patent application Ser. No. 12/886,773, filed on Sep. 21, 2010, and issued as U.S. Pat. No. 8,529,370 on Sep. 10, 2013, which claims priority to U.S. Provisional Patent Application No. 61/245,583, filed on Sep. 24, 2009, the disclosure of each of which is hereby incorporated by reference in its entirety herein. U.S. patent application Ser. No. 12/939,477 also is a continuation-in-part of U.S. Utility patent application Ser. No. 12/876,397, filed on Sep. 7, 2010, and issued on Apr. 23, 2013, as U.S. Pat. No. 8,425,349, which claims priority to U.S. Provisional Patent Application No. 61/242,469, filed on Sep. 15, 2009, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a multiple material golf club head. More specifically, the present invention relates to a multiple material golf club head with a compression-molded, thin-walled aft body.

Description of the Related Art

There are various problems with the current process for manufacturing multiple material golf club heads. For example, in a standard compression molding process, the hard metal tooling on both sides of the molding part makes it impossible to create undercuts without significantly increasing tool complexity. Another problem lies in the fact that standard molding compounds are not designed to be used in parts with very thin walls. When wall thicknesses are less than approximately 0.080 inches, it is difficult to compression mold most standard molding compounds. Furthermore, standard molding compounds are not as strong, stiff, or tough as laminated composites made with similar matrix and fiber types.

Laminates are typically made up of layers of aligned fibers embedded in a matrix. Each layer, or ply, has a minimum thickness that is predetermined by the raw materials when they are purchased. Plies in a manufactured part can be made thicker by stacking two or more layers of the same fiber orientation on top of one another, but there is no reasonable way to create thinner plies without purchasing different, more expensive materials. The limitation on the thickness of plies creates design constraints and limits the efficiency of even the best designs. For example, if a quasi-isotropic symmetric laminate is desired, there must be at least six plies used in order to create a $[0, 60, -60]_s$ laminate. A more common approach is to use eight plies and a $[0, 45, -45, 90]_s$ laminate. If, for example, the plies are 0.005 inches thick and eight plies must be used, the minimum part thickness is 0.040 inches. Even if analysis shows that 0.040 inches is thicker than necessary for the structural requirements of the part, the designer is limited by this minimum thickness. This leads to inefficient parts that are overbuilt and heavier than they need to be. Laminate composites also are not ideal because the raw materials typically used to make laminates are expensive. This cost is compounded by the very high scrap rate involved in molding them. Furthermore, the use of prepreg material requires hand placement of each layer of material into a mold, a time-consuming and labor-intensive process.

Another problem lies in the fact that latex bladders, which allow manufacturers to avoid undercut constraints, cause parts to lose definition on their inside surfaces. Metal tooling dictates the outer molding line (OML) of the parts quite well, but the part thickness and inner molding line (IML) of the molded parts are determined by the number of plies placed in each area and the amount of pressure exerted on the area by the bladder during the cure. As a result, it is difficult to predict the mass properties of a multiple-material body before a part is made.

One-piece bladder molded driver bodies also do not work well with a body-over-face joint. Bladder molded multiple material driver design had been restricted to body-under-face joints so that the body bond surface is a well controlled OML surface. The lack of precision on the inside of the head, however, makes it difficult to control the geometry of the body where it would meet up with the face.

Another problem lies with the fact that typical epoxy-based prepregs take at least twenty to thirty minutes, and often longer, to cure. In one multiple material golf club head fabrication process, the latex bladders used to apply pressure during the cure cycle can only be used two or three times before they need to be discarded. As such, bladders are a significant cost in the current multiple material golf club manufacturing process.

BRIEF SUMMARY OF THE INVENTION

One aspect of the present invention is a driver type golf club head comprising a metal face cup and a composite aft body comprising a crown and a sole, wherein the composite crown and sole are compression molded, wherein the composite in the crown and sole comprises fibers having random orientation, and wherein an outer molding line and an inner molding line of the crown and the sole are precision-molded.

The aft body may have a wall thickness of between 0.020 and 0.125 inches, and more preferably between 0.030 and 0.055 inches. The crown and sole may be molded separately. The composite used to form the crown and sole may comprise carbon fibers, and the carbon fibers may compose 10-70% of the volume of the composite in the crown and sole, and more preferably compose 40-50% of the volume of the composite in the crown and sole. The composite aft body may comprise at least twenty million carbon fibers. The composite used to form the crown and sole may further comprise a matrix material, preferably a thermosetting material, and most preferably a vinyl ester or epoxy. At least one of the face cup, crown, and sole may comprise alignment markings, and more preferably both the crown and sole comprise alignment markings. The metal face cup may comprise a material selected from the group consisting of titanium, titanium alloy, aluminum, aluminum alloy, steel, magnesium, and magnesium alloy, and more preferably is composed of a titanium alloy.

Another aspect of the present invention is a method of forming a composite aft body for a driver type golf club head, comprising providing a plurality of bundles of carbon fibers, mixing the plurality of bundles with a matrix material so that the bundles are assorted randomly to form a composite molding compound, providing a male and female metal tooling mold, placing the composite molding compound in the female metal tooling mold, compressing the composite molding compound within the female metal tooling mold with the male metal tooling mold to create a composite piece, allowing the composite piece to cure, and bonding the composite piece to another piece of the driver type golf club head, wherein each bundle of carbon fibers is unidirectional, and wherein each bundle includes no more than 12,000 carbon fibers. In a further embodiment of the present invention, each bundle includes no more than 3,000 carbon fibers. The matrix material used in this aspect of the invention may be a thermosetting material, and more preferably a vinyl ester or epoxy. Furthermore, the carbon fibers used in the present invention may each be between ¼ inch and 2 inches long.

Yet another aspect of the present invention is a golf club head comprising a metal face component and an aft body comprising a crown and a sole, wherein at least one of the crown and sole is compression molded from a composite molding compound, wherein the composite molding compound comprises carbon fiber bundles having random orientation, wherein the carbon fiber bundles are pre-spread prior to being processed into the molding compound, wherein each carbon fiber bundle includes no more than 12,000 carbon fibers, and wherein an outer molding line and an inner molding line of at least one of the crown and the sole are precision-molded. In some embodiments, the composite molding compound may comprise a plurality of carbon nanotubes, which may be selected from the group consisting of single wall carbon nanotubes and multi wall carbon nanotubes. In other embodiments, each carbon fiber bundle may include no more than 3,000 carbon fibers. In yet another embodiment, the composite molding compound may comprise carbon graphene platelets. In some further embodiments, the composite molding compound may comprise both long and short carbon fibers.

In some embodiments, 10-70% of the volume of the composite molding compound may be composed of carbon fibers. In other embodiments, the carbon fiber bundles may be derived from at least one ply of laminate prepreg. The metal face component of the golf club head may a material selected from the group consisting of titanium, titanium alloy, aluminum, aluminum alloy, steel, magnesium, and magnesium alloy, and in some embodiments, the composite used to form the crown and sole may further comprise a matrix material selected from the group consisting of a thermosetting material and a thermoplastic material. In a further embodiment, the matrix material may be a thermosetting material selected from a group consisting of a vinyl ester and epoxy.

Another aspect of the present invention is a method of forming a composite part for a golf club head, the method comprising pre-spreading a plurality of carbon fiber bundles so that a plurality of said carbon fiber bundles has a narrow, elongated cross-section, mixing the plurality of carbon fiber bundles with a matrix material so that the bundles are assorted randomly to form a composite molding compound, placing the composite molding compound in a first metal tooling mold, compressing the composite molding compound within the metal tooling mold with a second metal tooling mold to create a composite piece, allowing the composite piece to cure, and bonding the composite piece to another part of the golf club head. In a further embodiment, the method may comprise the step of mixing at least one additive material with the composite molding compound before it is placed in the first metal tooling mold, and the at least one additive material may be selected from the group consisting of carbon nanotubes, carbon graphene platelets, and short carbon fibers.

In some embodiments, the matrix material may be selected from a group consisting of a thermosetting material and a thermoplastic material. In a further embodiment, the matrix material may be a thermosetting material selected from a group consisting of a vinyl ester and epoxy. In yet another embodiment, each carbon fiber bundle may include no more than 12,000 carbon fibers, or no more than 3,000 carbon fibers.

Yet another aspect of the present invention is a golf club head comprising a metal face component and an aft body comprising a crown and a sole, wherein at least one of the crown and the sole comprises a laminate material, and wherein the laminate material comprises an exterior ply with a thickness of 0.007 inches or less and at least one interior ply with a thickness of 0.002 inch or less. In some embodiments, the at least one interior ply may have a thickness of 0.001 inch or less. In other embodiments, at least one of the crown and the sole may comprise a composite molding compound, which may comprise carbon fiber bundles having random orientation, and the carbon fiber bundles may be pre-spread prior to being processed into the molding compound, and each carbon fiber bundle may include no more than 12,000 carbon fibers.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention provides a solution to the problems set forth above by providing a preferred molding compound and an improved laminate material, which may be combined, as well as a process for forming a composite aft body for a golf club.

Molding Compound

To create the molding compound of the present invention, bundles of aligned carbon fibers are randomly assorted and combined with a matrix material to provide a lightweight, strong, low density, composite molding material. The molding process of the present invention involves placing the molding compound of the present invention in a molding tool and compression molding one or more pieces of a golf club body such that the pieces have both uniform strength and precise geometry control in the form of OML and IML surfaces. The compression molding process of the present invention thus eliminates the need for a consumable bladder and makes the golf club manufacturing process more efficient and cost-effective.

Molding Compound Fibers

Figure 1:
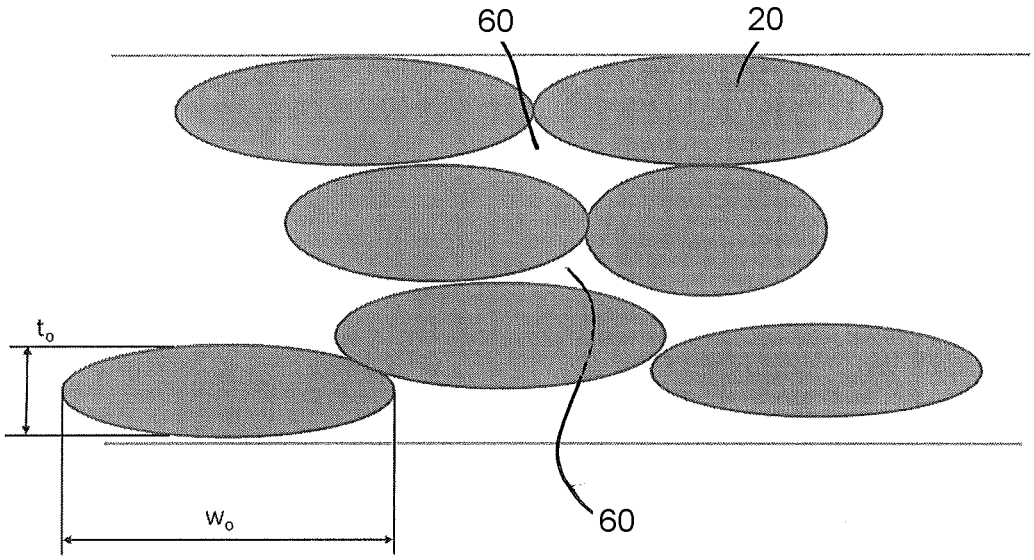
FIG. 1 is a cross-sectional view of a plurality of carbon fiber bundles during processing into a molding compound.
Figure 2:
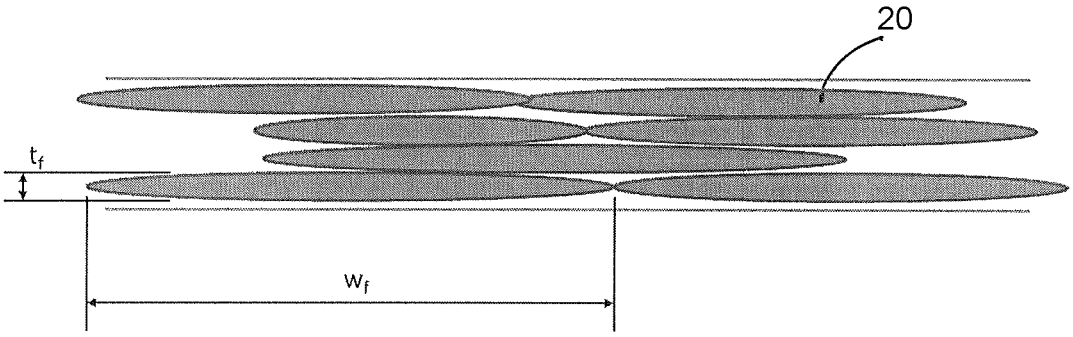
FIG. 2 is a cross-sectional view of the carbon fiber bundles shown in FIG. 1 during molding.

Standard molding compounds generally have a lower strength, stiffness and impact toughness than continuous fiber laminates (e.g., prepreg sheets). Molding compounds are typically made using bundles 20 of fibers, or tows, of a certain diameter and fiber count. The bundles 20 typically have an approximately circular cross section prior to processing, and the diameter of the bundle 20 is directly related to the number of fibers in the bundle 20. As shown in FIG. 1, during processing into the molding compound, the bundles 20 are compressed into an oval cross-sectional shape with dimensions $t_o$ and $w_o$. During molding, the cross section is compressed further into a very narrow oval shape with dimensions $t_f$ and $w_f$, as shown in FIG. 2. For this type of molding, $t_o$ is larger than $t_f$ and $w_o$ is almost always smaller than $w_f$. The dimensions of the oval shape depend on the part geometry, the position and orientation of the section cut, the molding conditions and the initial size of the tow in the molding compound. Larger bundles 20 generally end up with larger dimensions in the final part.

Larger bundles 20 are less expensive, but they also have several drawbacks. The larger fiber bundles 20 leave larger gaps 60 between bundles 20 in the finished part. The gaps 60 are filled with the matrix, which transfers loads between bundles 20. Larger bundles 20 generally create larger gaps 60 between fiber bundles 20. The load transfer is most effective when the gap 60 is small, as larger gaps 60 are more likely to concentrate stress and lead to failure. The second drawback to large bundles 20 is that there aren't as many bundles 20 for a given part thickness. In the example illustrated in FIGS. 1 and 2, there are four bundles 20 through the thickness. These fibers are randomly oriented, and with fewer bundles 20 through the thickness, there is a higher probability that all or most of the bundles 20 will align or nearly align. If the fibers in the bundles 20 through the thickness of a part are aligned (or nearly aligned), the part will have extra strength and stiffness at that location along the direction of the fibers. However, that location also has decreased strength and stiffness in the direction perpendicular to the fibers.

As discussed herein, the inventors have determined several ways to improve the material properties of molding compounds. One way of improving the material properties of standard molding compounds is to utilize longer carbon/graphite fibers and higher fiber content. The inventors have determined that the combination of strength and toughness available from "long fiber" material is adequate for a golf club head application. Fibers between ¼" and 2" long are the long fibers utilized in the preferred molding compound, while fibers less than ¼" long are short fibers.

In addition, or alternatively, adding micro- and nano-fillers (e.g., carbon nanotubes, nanoclays, etc.) can increase the material properties of standard molding compounds. Another approach to improve the material properties of standard molding compounds is to use a combination of continuous fiber-reinforcement (prepreg) and molding compounds. Molding compounds of interest can be reinforced by fibers, including carbon, fiberglass, aramid or any combination of the three.

Figure 3:
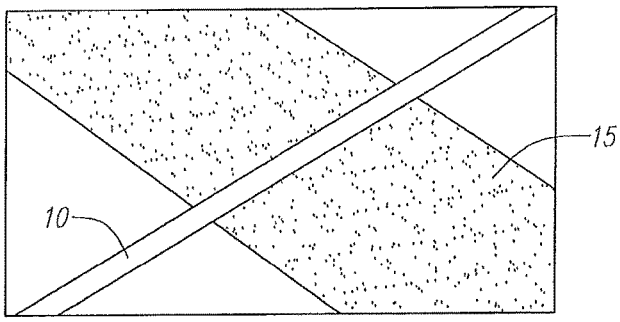
FIG. 3 is a drawing photograph of a carbon fiber and a human hair.
Figure 4:
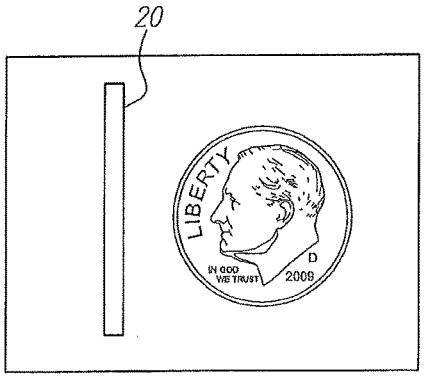
FIG. 4 is a drawing of a carbon fiber bundle next to a U.S. dime.
Figure 5:
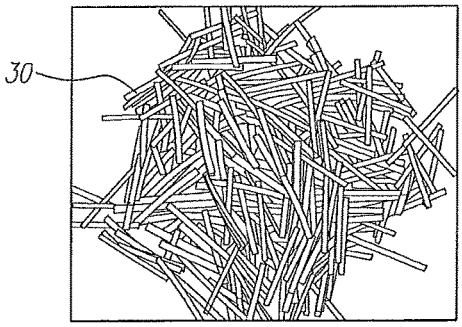
FIG. 5 is a drawing of a group of carbon fiber bundles.
Figure 6:
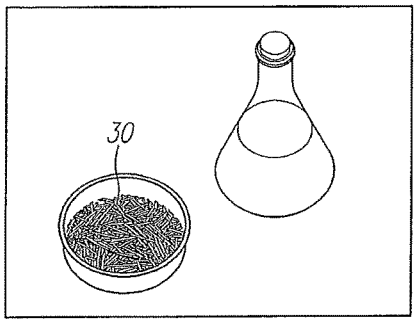
FIG. 6 is a drawing of the carbon fiber bundles shown in FIG. 5 next to a beaker of matrix material.

FIG. 3 shows a single carbon fiber 10 compared with a human hair 15, and FIG. 4 shows a bundle 20 of 3,000 unidirectional carbon fibers compared with a U.S. dime. According to the present invention, a bundle can comprise up to 12,000 carbon fibers. In one embodiment of the molding compound of the present invention, the fiber bundles 20 comprise 3,000-fiber tows instead of the 12,000-fiber (or more) tows. A plurality of these 3,000-fiber tow bundles are randomly assorted within a small area and combined with a matrix material to create a material that comprises over 500,000 randomly assorted fibers per square inch in a typical golf club component, or, more generally, ten million randomly assorted fibers per cubic inch. FIG. 5 shows an example of random assortment 30 of carbon fiber bundles according to the present invention, and FIG. 6 shows a random assortment 40 of carbon fiber bundles associated with a matrix material.

Random assortment of the fiber bundles within the matrix material results in the directionality of each of the fiber bundles being randomly oriented, which improves the minimum expected strength of the resulting material. When one embodiment of the molding compound of the present invention is used to create an aft body of, for example, a 420 to 470 cc golf club driver, the aft body may comprise over twenty million fibers in total, and preferably at least twenty three million fibers. The greater the number of bundles there are through the thickness of a part, the less likely it is that all the bundles through the thickness will be aligned at any location. With an increase in fiber bundles through the part thickness, the probability of fiber alignment decreases and the minimum expected values for strength and stiffness increase at any point along the part. When the minimum expected strength and stiffness increase, designers can create thinner, lighter, more efficient parts.

In the preferred embodiment of the present invention, the fiber bundles 20 are pre-spread (also known as "spread-tows") as shown in FIG. 2 and have a narrow, elongated oval cross-section prior to processing into a molding compound, rather than using the standard circular cross section tows. Starting out with spread tows allows for the inclusion of a greater number of fiber bundles 20 through the thickness, reduces the size of the resin rich areas, and increases the minimum expected values for tensile strength and elastic modulus in the final part. Adding single wall or multi wall carbon nanotubes, or carbon graphene platelets to the chopped fiber molding compound matrix also helps to add strength and stiffness, especially in the resin rich areas. Adding very short lengths of carbon fibers to the matrix also helps to reinforce what would otherwise be resin rich areas. Improving the strength and stiffness of the resin rich areas leads to improved minimum expected strength and stiffness of the entire part.

Molding Compound Matrix Material

The matrix material that is combined with the fiber bundles to create the molding compound of the present invention can be a thermosetting (epoxy, polyester, vinyl ester, etc.) or a thermoplastic (nylon, polycarbonate, PPS, PEKK, PEEK, etc.) material, preferably a thermosetting material, and most preferably a vinyl ester or epoxy. Alternatively, epoxy-based matrix compounds may be utilized since these compounds provide better strength and impact resistance than vinyl ester. Vinyl ester matrix molding compounds are strong and can cure in as little as one minute. Quick curing epoxy-based molding compounds have cure times as low as five minutes. The fiber in the resulting molding material may compose approximately 40 to 50%, and up to 70%, of the total molding material by volume.

Molding Compound Characteristics

Due to the fiber bundle diameter, size, and random assortment, the molding compound of the present invention is lighter than a piece of titanium having the same size and shape and has a density that is equivalent to approximately one third of the density of titanium. It also allows for more gradual changes in thickness throughout a part, which leads to further improvement in efficiency. The inventive material further increases the design freedom of a compression molded chopped fiber part, increases the minimum expected strength and stiffness of a part, reduces the minimum wall thickness, decreases interlaminar shear stress, and reduces the size of resin rich areas between fiber bundles, all of which increase the minimum expected value of strength and stiffness and decrease the total expected variation in strength and stiffness in the final part.

Figure 7:
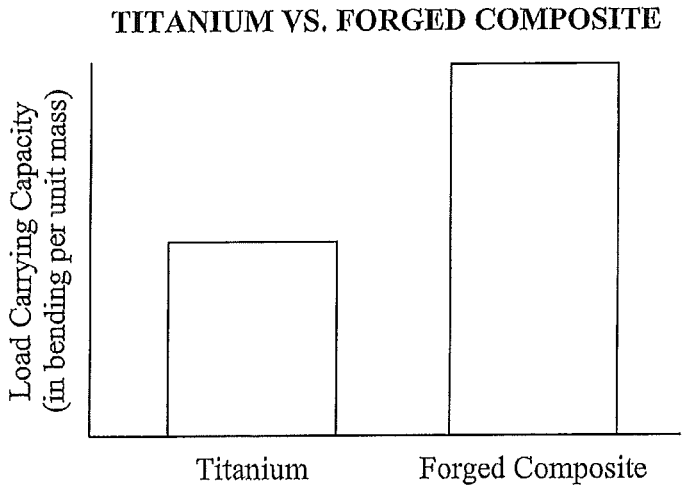
FIG. 7 is a graph showing load carrying capacities of titanium and composite materials.

In the preferred embodiment, the density of the molding compound is between 1 and 2 grams per cubic centimeter, and most preferably is approximately 1.5 grams per cubic centimeter. As such, a golf club aft body formed from the composite compound of the present invention will be lighter and less dense than an aft body formed from titanium. The molding compound of the present invention also has a higher load carrying capacity than titanium in terms of bending per unit mass. FIG. 7 shows that the molding composite of the present invention has approximately twice the load carrying capacity of titanium per unit mass.

The molding composite ("MC") of the present invention can carry 2.4 times as much bending moment as a Titanium beam. The equation for stresses in a beam subjected to a bending moment is as follows, $$\sigma(y) = \frac{My}{I},\ I = \frac{bh^3}{12}$$

where σ is the tensile or compressive stress along the length of the beam, M is the applied moment, y is the distance above the neutral axis, b is the beam width, and h is the beam thickness. The stress in the beam varies linearly through its thickness, with extremes occurring on the top and bottom surfaces.

$$\sigma_{max} = \sigma(y = \pm h/2) = \pm\frac{6M}{bh^2}$$

If the moment is positive, the maximum tensile stress occurs at the top surface of the beam, where y=h/2. To compare beams made from titanium to beams made of the molding compound of the present invention, it is useful to consider beams of equal mass. In the design of a driver body, the most convenient design flexibility often lies in the ability to change wall thickness. To represent this flexibility, two beams of equal width and length, but with different thicknesses, are compared. The thicknesses are scaled according to material density to create the dimensions of beams of equal mass.

The density of titanium is roughly three times that of the molded composite of the present invention, so the titanium beam needs to be one third as thick in order to have the same mass. Using the equations above, the stresses in the two beams are compared.

$$\sigma_{max,Ti} = \frac{6M}{b\left(\frac{h_{MC}}{3}\right)^2} = \frac{54M}{bh_{MC}^2} = 9\sigma_{max,MC}$$

Titanium and the molding composite ("MC") of the present invention have the following bending moment relationship, which demonstrates a strength advantage of the molding compound of the present invention.

$$\sigma_{max,Ti}/\sigma_{y,Ti} = 2.4(\sigma_{max,MC}/\sigma_{u,MC})$$

The lower density of the molding compound of the present invention allows for thicker cross-sections at equivalent mass, and the resulting load carrying capacity is much greater. This allows designers to reinforce areas of a club head subjected to large bending loads without adding as much mass as would be required with a titanium head. The result is a more efficient head design and more discretionary mass, which can be used to help make drivers longer and straighter. The mass can be used to improve forgiveness through the use of selective weighting and center of gravity (CG)/moment of inertia (MOI) optimization, or it can be removed from the head for higher head speeds and longer drives.

Figure 8:
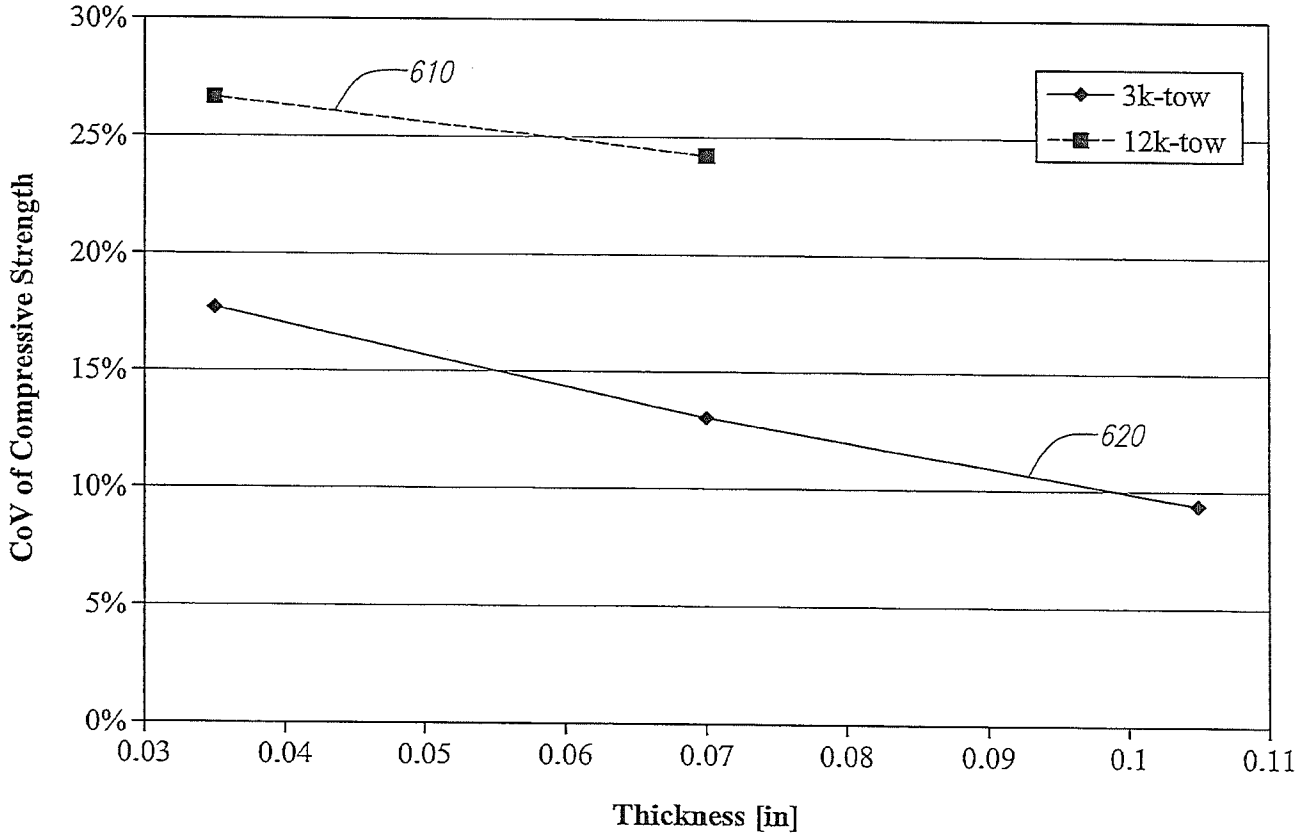
FIG. 8 is a graph of a standard deviation n in strength versus thickness of a standard molding compound and thickness of the molding compound of the present invention.

In addition to allowing for lightweight, strong, and low-density construction of a golf club head, the molding compound of the present invention resolves concerns regarding strength variation. Statistically, the variation in strength of a standard compression molded part increases as specimen thickness decreases. Without sufficient thickness, the random nature of the fiber distribution in ordinary composite materials having 12,000 or more fibers per bundle can lead to a greater chance of there being weak spots in the finished golf club head component, and thus a greater variation in strength, as shown by the dotted line 610 in FIG. 8. In contrast, the smaller carbon fiber bundle diameters (3,000-fiber tow versus 12,000-fiber (or more) tow) used in the molding compound of the present invention allow for a more uniform distribution of fiber orientations for a given part thickness, and thus provide greater strength consistency, as shown by the solid line 620 in FIG. 8.

The use of smaller diameter fiber bundles also assist with molding thin components for a golf club head. The standard compression molding process preferably uses hard metal tooling to apply pressure on both sides of the golf club head component. During the molding process, the molding material of the present invention is forced into the cavity between the two tool surfaces. The hard metal tooling on the IML allows for a precise bond surface geometry on either side of the golf club head component. As a result, the IML surface is just as precise as the OML surface.

Standard molding compounds, however, could not be used to obtain precise IML/OML surfaces, sufficient strength, and uniform fiber distribution in molded composite parts. In contrast, the molding compound of the present invention may be compression molded to achieve strong composite parts having precise OML and IML surfaces as well as uniform distribution of fiber orientation, thus providing a composite piece that is both strong and precisely formed. A two-piece compression molded body allows a manufacturer to create both a body-over face joint and a body-under face joint and avoid having undercuts.

The molding compound of the present invention also allows for a reduction in scrap when compared to laminated parts, thereby providing savings. Exact placement of the raw material in a molding tool is not required—instead, the raw material is prepared in a form that allows for just one piece of material per golf club head component, which has the effect of eliminating the labor intensive lay-up process as well as scrap waste. As such, the molding compound of the present invention allows for more efficient and environmentally sound manufacturing.

Molding Process

Figure 9:
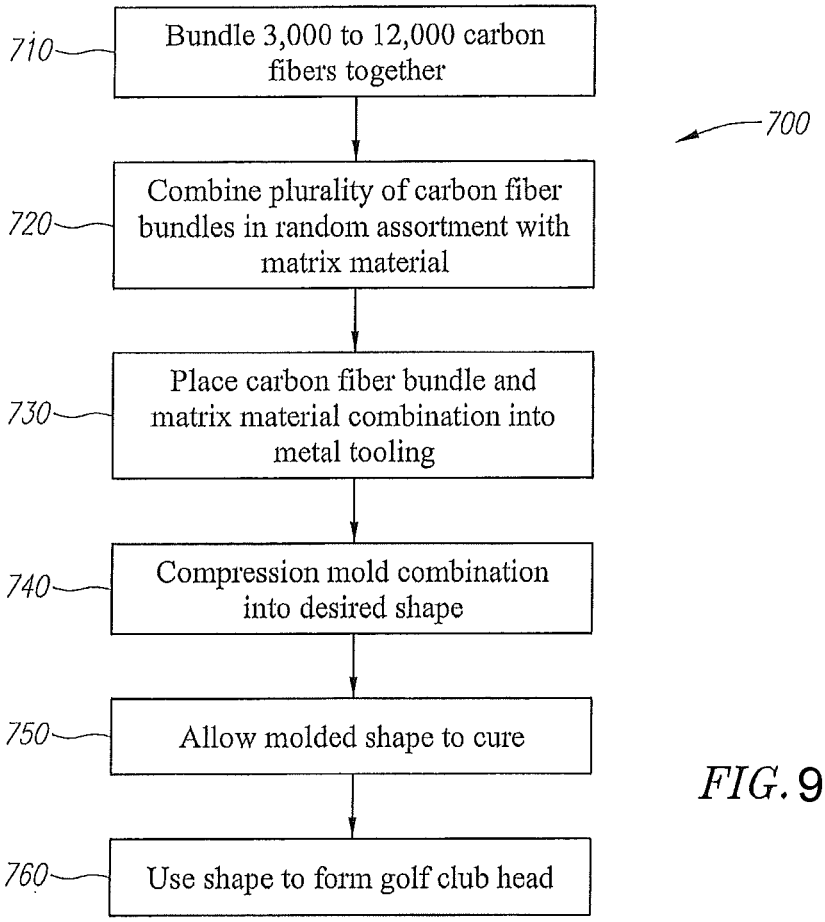
FIG. 9 is a flow chart showing a process for molding a composite compound.

FIG. 9 is a flow chart showing a process 700 for forming a piece of a golf club body using the molding compound of the present invention. In step one 710 of the process 700, approximately 3,000 to 12,000 carbon fibers, and preferably 3,000 carbon fibers, are bundled together to create a unidirectional bundle of carbon fibers having a small diameter. In step two 720, a plurality of said bundles of carbon fibers are randomly assorted and combined with a matrix material to form the molding compound of the present invention. In step three 730, a piece of the molding compound having a desired size and/or shape is placed into a metal tooling. In step four 740, the molding compound is compression molded using the metal tooling to take a desired shape, preferably a crown or sole of a golf club aft body. In step five 750, the molded shape is permitted to cure. In step six 760 of the process 700, the molded shape is used to form a golf club head, and preferably is affixed to other pieces of the golf club head using an adhesive.

Example 1

Figure 10:
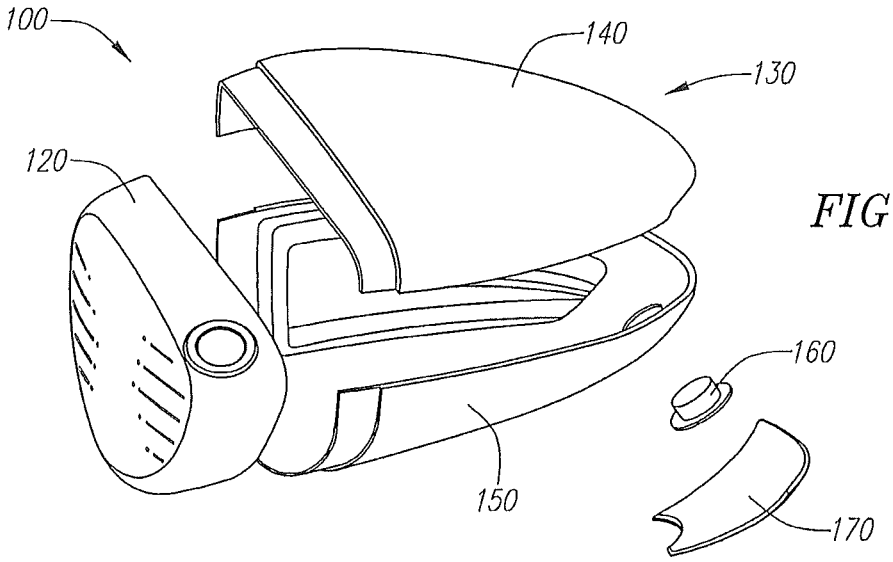
FIG. 10 is an exploded, perspective view of an embodiment of the present invention.

A preferred embodiment of a golf club head 10 formed using the molding compound and molding process of the present invention is shown in FIG. 10. The golf club head 100 is a driver-type head comprising a face cup 120 and an aft body 130 comprising a crown piece 140 and a sole piece 150. The golf club 100 of the present invention may optionally comprise additional pieces, including, but not limited to, a swing weight 160, a rear cover 170, and a ribbon or skirt (not shown) interposed between the crown 140 and sole 150 pieces.

Figure 11:
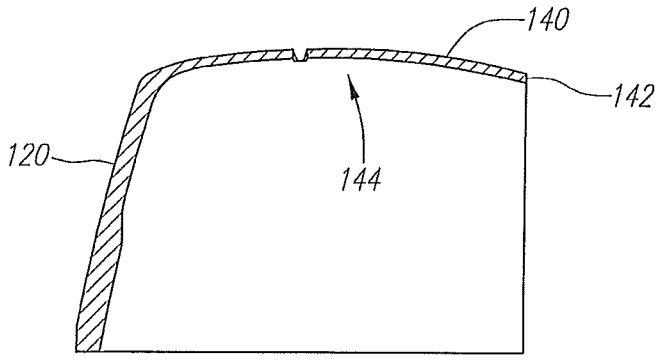
FIG. 11 is an isolated view of a face component aft body joint of the embodiment shown in FIG. 10.

The crown piece 140 and sole piece 150 of the aft body 130 are separately compression molded using the molding compound and process of the present invention. Forming the aft body 130 in two or more pieces makes it easier for a manufacturer to mold the aft body 130, because it is easier to mold half of an aft body 130 than to mold the whole aft body 130 at once. It also removes the need for undercuts. The compression molding process of the present invention allows for a precise OML radius 142 and IML, radius 144 for both the crown 140 and the sole 150, shown for the crown 140 in FIG. 11.

Figure 12:
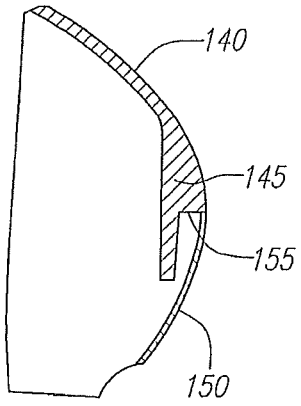
FIG. 12 is an isolated view of a crown-sole joint of an aft-body of the embodiment shown in FIG. 10.
Figure 13:
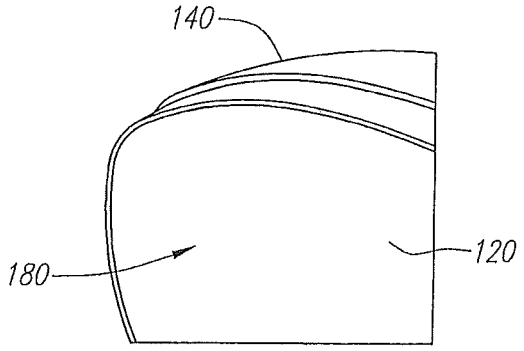
FIG. 13 is an isolated view of an alignment feature of a crown section of the embodiment shown in FIG. 10.

The compression molded crown 140 and sole 150 have wall thicknesses in the 0.020 to 0.125 inch range, and preferably between 0.030 and 0.055 inches, which is a standard thickness range for golf club aft bodies, except for areas which may be thicker to accommodate joint geometry. FIG. 12 shows the joint areas 145, 155 of the crown 140 and sole 150, which are thicker than other portions of the crown and sole and are aligned to join the two aft body pieces 140, 150 together. The joints 145, 155 may have features that are specifically formed to prevent misalignment during bonding and assembly. As shown in FIG. 13, the club head has alignment features 180 for proper assembly.

The compression molded parts 140, 150 are joined together to form a complete composite aft body 130, and the aft body 130 is bonded to the face cup 120, which is preferably made of a metal material, and most preferably made of a titanium alloy. The types of adhesives used to join the golf club head components together include, but are not limited to epoxies and acrylics in liquid, film and paste forms. The compression molded parts 140, 150 may be a combination of continuous reinforcement and molding compounds.

The aft body of the embodiment shown in FIG. 10 is preferably constructed from a "long fiber" material consisting of the following combination of constituent materials: 20-70% carbon (graphite) fiber by volume; 30-80% thermoplastic or thermoset polymer resin by volume; and up to 20% of other filler materials, including other fibers (Kevlar, fiberglass, nanofibers, nanotubes, or the like). The constituent materials having the following properties: thermoplastic or thermoset polymer resin having a specific gravity between 1.0 and 1.7; carbon (graphite) fiber specific gravity between 1.6 and 2.1; and carbon (graphite) fiber having a tensile modulus of between 25 and 50 Msi.

Laminate Material

The strength and toughness available from existing laminated composite can also be adequate for the construction of a golf club head, but the benefits provided by prior art laminate prepregs are outweighed by the higher cost, slower cycle time, and lack of precision in wall thickness and IML and OML. One way to counteract these disadvantages is to use thinner plies of prepreg, which until recently have been prohibitively expensive.

The inventive carbon fiber material allows for more design freedom in composite laminate parts, as it permits more complex layups, reduces minimum wall thickness, reduces interlaminar shear stress, and improves optimization for relevant load cases and applications. When the material is used in connection with a laminate, the desired goal is to reduce the thickness of the plies to improve the resulting part. In an embodiment of the invention including laminate, the golf club head has a woven exterior ply with a thickness of is 0.007 inches or less, and interior plies each having a thickness of 0.002 inches or less. A more preferable embodiment has no exterior ply and instead includes interior plies each having a thickness of 0.001 inches or less.

Combination Material

In another embodiment of the present invention, the laminate material disclosed herein is shredded and used as the composite fiber component of the molding compound disclosed herein. In yet another embodiment, plies of the laminate material may be co-molded in a mold with the molding compound disclosed herein.

The golf club of the present invention may also have material compositions such as those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

The golf club head of the present invention may be constructed to take various shapes, including traditional, square, rectangular, or triangular. In some embodiments, the golf club head of the present invention may take shapes such as those disclosed in U.S. Pat. Nos. 7,163,468, 7,166,038, 7,169,060, 7,278,927, 7,291,075, 7,306,527, 7,311,613, 7,390,269, 7,407,448, 7,410,428, 7,413,520, 7,413,519, 7,419,440, 7,455,598, 7,476,161, 7,494,424, 7,578,751, 7,588,501, 7,591,737, and 7,749,096, the disclosure of each of which is hereby incorporated in its entirety herein.

The golf club head of the present invention may also have variable face thickness, such as the thickness patterns disclosed in U.S. Pat. Nos. 5,163,682, 5,318,300, 5,474,296, 5,830,084, 5,971,868, 6,007,432, 6,338,683, 6,354,962, 6,368,234, 6,398,666, 6,413,169, 6,428,426, 6,435,977, 6,623,377, 6,997,821, 7,014,570, 7,101,289, 7,137,907, 7,144,334, 7,258,626, 7,422,528, 7,448,960, 7,713,140, the disclosure of each of which is incorporated in its entirety herein. The golf club of the present invention may also have the variable face thickness patterns disclosed in U.S. Patent Application Publication No. 20100178997, the disclosure of which is incorporated in its entirety herein.

The mass of the club head of the present invention ranges from 165 grams to 250 grams, preferably ranges from 175 grams to 230 grams, and most preferably from 190 grams to 205 grams. The crown component has a mass preferably ranging from 4 grams to 30 grams, more preferably from 15 grams to 25 grams, and most preferably 20 grams.

The golf club head of the present invention preferably has a volume that ranges from 290 cubic centimeters to 600 cubic centimeters, and more preferably ranges from 330 cubic centimeters to 510 cubic centimeters, even more preferably 350 cubic centimeters to 495 cubic centimeters, and most preferably 415 cubic centimeters or 470 cubic centimeters.

The center of gravity and the moment of inertia of a golf club head of the present invention are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety.

The moment of inertia, Izz, about the Z axis for the golf club heads of the present invention preferably ranges from 2800 g-cm$^2$ to 6000 g-cm$^2$, preferably from 3000 g-cm$^2$ to 600 g-cm$^2$, and most preferably from 5000 g-cm$^2$ to 6000 g-cm$^2$. The moment of inertia, Iyy, about the Y axis for the golf club head preferably ranges from 1500 g-cm$^2$ to 5000 g-cm$^2$, preferably from 2000 g-cm$^2$ to 5000 g-cm$^2$, and most preferably from 3000 g-cm$^2$ to 4500 g-cm$^2$. The moment of inertia, Ixx, about the X axis for the golf club head 40 preferably ranges from 1500 g-cm$^2$ to 4000 g-cm$^2$, preferably from 2000 g-cm$^2$ to 3500 g-cm$^2$, and most preferably from 2500 g-cm$^2$ to 3000 g-cm$^2$.

The golf club heads of the present invention preferably have coefficient of restitutions ("COR") ranging from 0.81 to 0.875, and more preferably from 0.82 to 0.84. The golf club heads preferably have characteristic times ("CT") as measured under USGA conditions of 256 microseconds.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. The section titles included herein also are not intended to be limiting. Therefore, the embodiments of the invention in which an exclusive property or privilege is claimed are defined in the following appended claims.

We claim:

1. A golf club head comprising at least one part, wherein the at least one part comprises a first molding compound, wherein the first molding compound comprises a matrix material, a plurality of carbon fibers having a length of less than 0.25 inch, and at least one of a plurality of carbon nanotubes and a plurality of carbon graphene platelets, wherein the carbon fibers are randomly oriented within the matrix material, and wherein the golf club head has a coefficient of restitution of 0.81 to 0.84.

2. The golf club head of claim 1, wherein each of the plurality of carbon nanotubes is a multi-wall carbon nanotube.

3. The golf club head of claim 1, wherein 40-70% of the volume of the first molding compound is composed of carbon fibers.

4. The golf club head of claim 1, wherein the matrix material is a thermosetting material.

5. The golf club head of claim 4, wherein the thermosetting material is selected from the group of a vinyl ester and an epoxy.

6. The golf club head of claim 1, further comprising a second molding compound comprising a matrix material and carbon fibers having a length of at least 0.25 inch and no more than 2 inches, wherein the second molding compound is co-molded with the first molding compound to form the part.

7. The golf club head of claim 1, wherein the first molding compound comprises a plurality of fiberglass fibers.

8. The golf club head of claim 1, wherein the first molding compound comprises a plurality of aramid fibers.

9. A golf club head comprising at least one part, wherein the at least one part comprises a laminate composite material and a molding compound, wherein the molding compound comprises a matrix material, a plurality of carbon fibers having a length of at least 0.25 inch and no more than 2 inches, and at least one of a plurality of carbon nanotubes and a plurality of carbon graphene platelets, wherein the carbon fibers are randomly oriented within the matrix material, wherein the matrix material is selected from the group consisting of a vinyl ester and an epoxy, and wherein the laminate composite material and the molding compound are co-molded to form the part.

10. The golf club head of claim 9, wherein the at least one part has a wall thickness of no less than 0.020 inch and no more than 0.125 inch.

11. The golf club head of claim 9, wherein the molding compound comprises at least one filler selected from the group consisting of nanofibers, nanotube fibers, aramid fibers, and fiberglass fibers.

12. The golf club head of claim 9, wherein the matrix material has a specific gravity of no less than 1.0 and no more than 1.7.

13. A golf club head comprising at least one part, wherein the at least one part comprises a laminate composite material and a molding compound, wherein the molding compound comprises a matrix material, a plurality of carbon fibers having a length of less than 0.25 inch, and at least one of a plurality of carbon nanotubes and a plurality of carbon graphene platelets, wherein the carbon fibers are randomly oriented within the matrix material, and wherein the laminate composite material and the molding compound are co-molded to form the part.

14. The golf club head of claim 13, wherein the at least one part is selected from the group consisting of a crown and a sole.

15. The golf club head of claim 13, wherein the at least one part has a wall thickness of no less than 0.020 inch and no more than 0.125 inch.

16. The golf club head of claim 13, wherein the molding compound comprises at least one filler selected from the group consisting of nanofibers, nanotube fibers, aramid fibers, and fiberglass fibers.

* * * * *